US005088308A

United States Patent [19]

Cole et al.

[11] Patent Number: 5,088,308

[45] Date of Patent: Feb. 18, 1992

[54] METHOD OF MAKING SPACER BARS

[75] Inventors: Richard D. Cole, Plainview; Howard T. Anger, Nesconset, both of N.Y.

[73] Assignee: Hygrade Metal Moulding Manufacturing Corp., Farmingdale, N.Y.

[21] Appl. No.: 674,673

[22] Filed: Mar. 25, 1991

Related U.S. Application Data

[63] Continuation-in-part of Ser. No. 630,517, Dec. 20, 1990.

[51] Int. Cl.[5] ..... B21D 5/00

[52] U.S. Cl. ..... 72/46; 29/897.312; 52/312

[58] Field of Search ..... 72/46, 307, 379.2; 29/897.312, 897.3; 52/456, 312, 313; 49/381, 504

[56] References Cited

U.S. PATENT DOCUMENTS

| | | | |
|---|---|---|---|
| 2,156,107 | 4/1939 | Bowman | 72/46 |
| 3,438,110 | 4/1969 | Lavallée | 29/897.312 |
| 3,832,962 | 9/1974 | Rolles | 72/46 |
| 4,455,850 | 6/1984 | Switten | 72/46 |
| 4,723,388 | 2/1988 | Zieg | 52/456 |

FOREIGN PATENT DOCUMENTS

| | | | |
|---|---|---|---|
| 115624 | 6/1986 | Japan | 72/46 |
| 1326365 | 7/1987 | U.S.S.R. | 72/46 |

*Primary Examiner*—David Jones

*Attorney, Agent, or Firm*—Kane, Dalsimer, Sullivan, Kurucz, Levy, Eisele and Richard

[57] ABSTRACT

A method of manufacturing a spacer bar having a color appearing on the exposed side in an assembled insulating glass unit including the steps of applying a portion of paint to a coil from which material is slit to form the spacer bars, slitting said coil in a dimension sufficient to form the bar and forming the material into a spacer bar wherein the exposed portion of the spacer has the color thereon.

4 Claims, 2 Drawing Sheets

METHOD OF MAKING SPACER BARS

CROSS REFERENCE TO RELATED APPLICATION

This application is a continuation-in-part Of U.S. patent application Ser. No. 630,517 filed Dec. 20, 1990, the disclosure of which is incorporated herein by reference.

FIELD OF INVENTION

The present invention relates to a method of making hardware for windows, in particular spacer bars.

BACKGROUND OF INVENTION

The fabrication of insulating glass involves the use of two sheets of glass having an air buffer therebetween. In this regard the insulating glass is often fabricated using spacer bars to which the sheets glass are affixed. The spacer bars used may be fabricated out of a variety of material however, metal such as aluminum is common. The spacer bar is typically unpainted with the metal appearance in certain application detracting from that of the window. In such applications it is desirable to have the exposed portion of the spacer that being the side inside between the panes of glass painted a desired color.

However since the spacer bar is disposed within the insulating glass, painting must be done prior to fabrication.

SUMMARY OF THE INVENTION

It is therefore a principle object of the invention to provide for a means of making spacer bars having the exposed side when assembled painted with a color which is relatively simple and inexpensive.

It a further object of the invention to provide for such a spacer bar which allows for its manufacture with existing manufacturing process for such bars particularly when fashioned out of metal.

The present invention provides for such objectives by utilizing a method of manufacturing spacer bars which are painted with the desired color prior to fabrication. The manufacture of spacer bars which typically starts with a metal coil (eg. aluminum) usually involves taking a wide coil and slitting it into narrow coils, the width of which corresponds to the amount of material necessary to form the sides of a spacer bar. The narrow coil is then formed into the spacer shape. The invention involves determining the width of material making up the desired size of spacer bar and prior to slitting painting the desired color (eg. white, brown etc.) on a portion thereof comprising one side of the spacer bar. The coil is then slit and formed along an axis which will provide the exposed side with the painted surface. This allows the fabricator to decide prior to fabrication what colors will make up the exposed side of the spacer bar. The result is that fabricators need only provide the painting of the coil along a portion thereof. Such a step is included in the manufacturing process without requiring additional machinery or otherwise disrupting existing manufacturing procedure.

Moreover, by limiting the painting to only the exposed portion, it avoids having paint on the sides on which the glass bonded. This avoids the situation where the glass is bonded to the paint and the paint to the metal. Bonding directly to the metal is the preferred means of attachment and is maintained with the present invention.

BRIEF DESCRIPTION OF THE DRAWINGS

Thus by the present invention its objects and advantages will be realized, the description of which should be taken in conjunction with the drawings, wherein.

DETAILED DESCRIPTION OF THE PREFERRED EMBODIMENT

Figure 1:
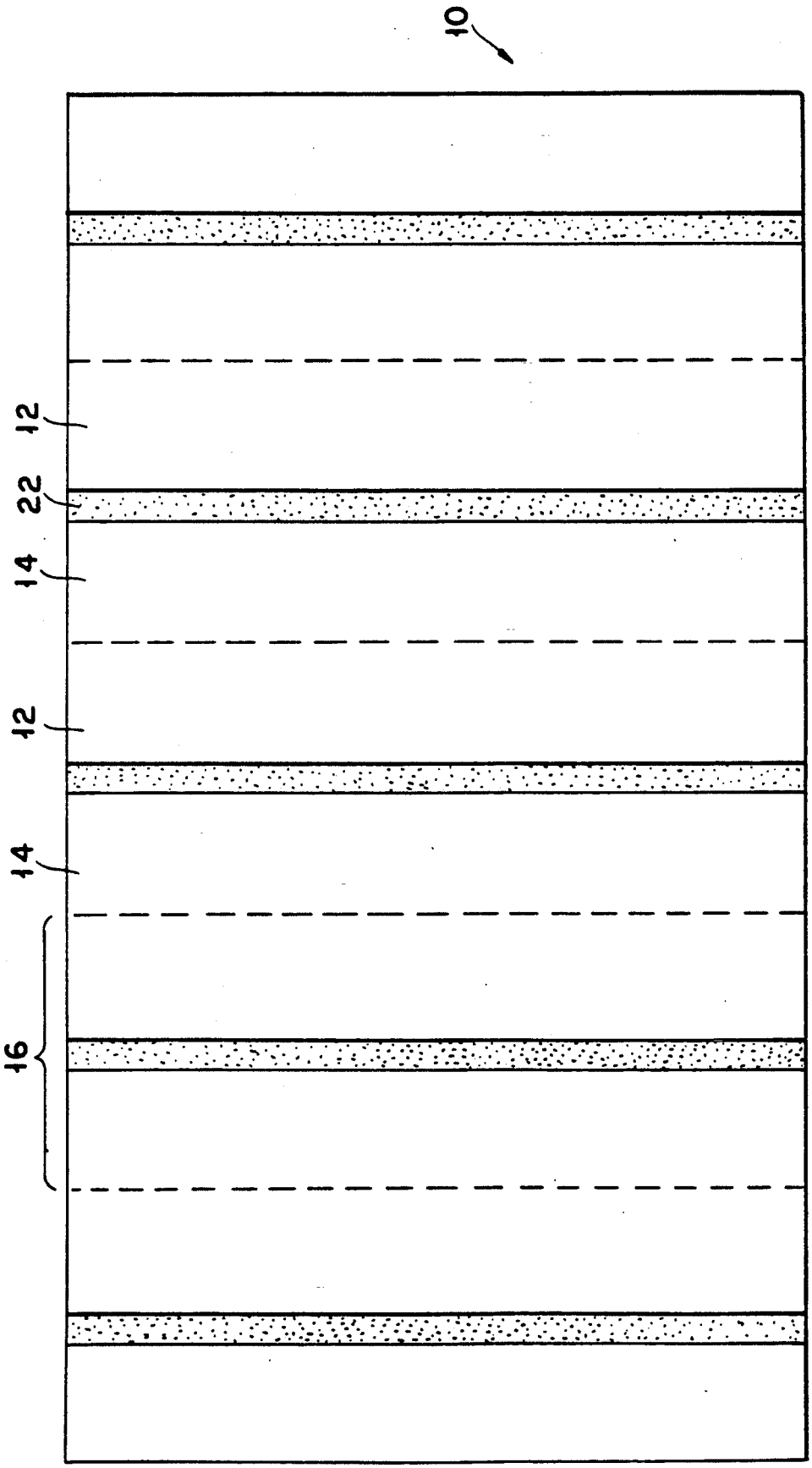
FIG. 1 is a perspective view of a wide coil of material painted to provide the painted portion of a spacer bar, incorporating the teachings of the present invention.

Turning now more particularly to the drawings, in FIG. 1 there is shown a sheet of material 10 which is made of metal, preferably aluminum. The sheet 10 normally is that taken off a coil of material which is processed into spacer bars. Typically the sheet width is approximately 24" but may be of any other size convenient to the manufacturing process.

Figure 2:
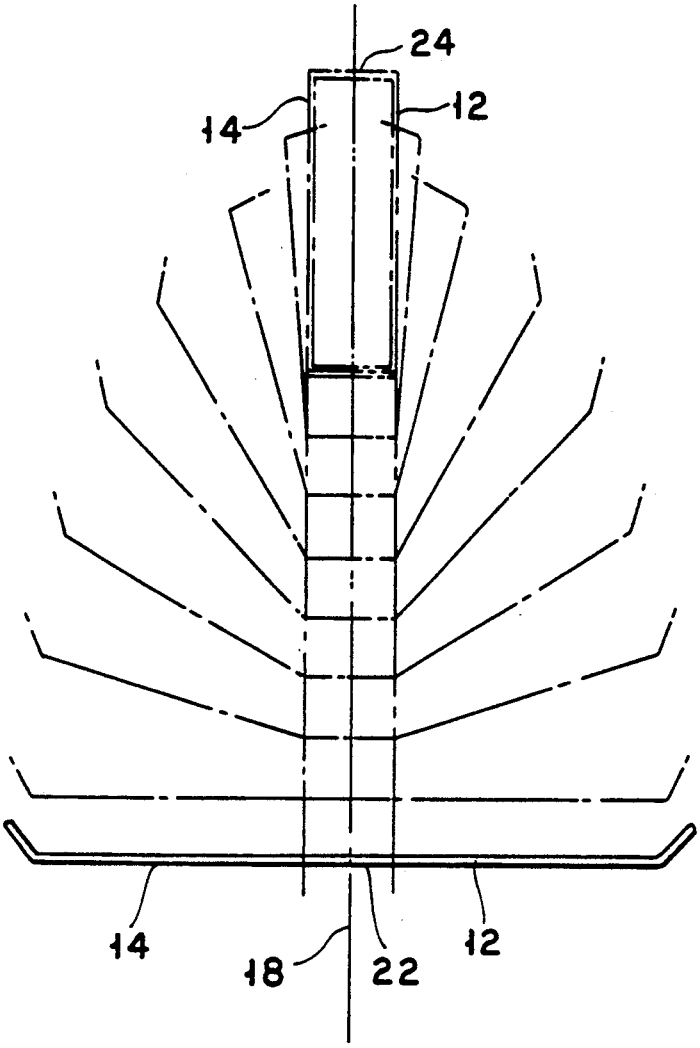
FIG. 2 is an end view of a slit coil of material shown in a successive folding process to form a rectangular spacer bar, incorporating the teaching of the present invention.
Figure 3:
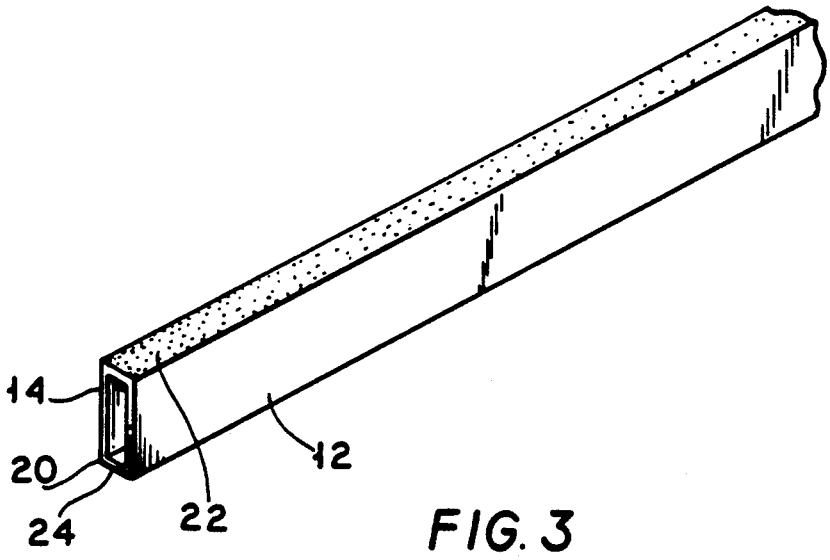
FIG. 3 is a perspective view of a painted spacer bar, incorporating the teachings of the present invention.

The sheet 10 is processed by slitting it into narrow coils which are then formed into a rectangular shape to form a spacer bar. The width of the coil of course will vary with the size and shape of the spacer being fabricated. A typical forming process is illustrated in FIG. 2 with regard to a rectangular shaped spacer. However, the method disclosed herein is equally applicable to spacers of differing sizes and shapes. Prior to slitting the sheet material is painted in the desired color eg. white. To effect the painting of a spacer bar along its exposed side, the width of material used to form the spacer bar is painted only along a section thereof. In this regard assume the opposite sides on which the glass is to be bonded and an outer leg of the spacer bar are formed from material designated 12 and 14 and that the entire spacer bar is fabricated from the amount of material designated 16. This section 16 is then slit from the sheet 10 which is then subject to the forming process as shown in FIG. 2. In this process, axis 18 acts as a dividing line to create a spacer bar 20.

Prior to slitting however, the portion of the material which would form the exposed portion of spacer bar in the assembled window (i.e. inside and between the panes of glass) is painted with a desired color, typically white. This portion is designated with the numeral 22. During the forming process, portion 22 which is painted provides an aesthetically pleasing appearance in the assembled window whereas heretofore exposed metal would normally show. Moreover, by the present invention, painting of the entire sheet material is avoided, just a sufficient width need be applied thus reducing the amount of paint used, the cost of production and leaving the surfaces on which the glass is bonded bare metal, providing for a more desired bonding effect. On the opposite side of portion 22 the spacer bar joined in a know fashion such as welding along line 24 to complete the spacer bar 20.

Thus by the present invention its objects and advantages are realized and although a preferred embodiment has been disclosed and described in detail herein, its scope should not be limited thereby, rather its scope should be determined by that of the appended claims.

What is claimed is:

1. A method of making a spacer bar for use in insulating glass units fabricated from glass in association with spacer bars comprising the following steps:

providing a sheet of formable material;

applying on a selected portion of one side of the sheet a colored material along a length of the sheet of material; and forming the material into a spacer bar such that the colored material is exposed substantially only upon a side of the spacer bar disposed between the glass making up the insulating glass units.

2. The invention in accordance with claim 1 which further includes the following steps:

said providing step comprises providing said sheet from a coil of material from which a plurality of spacer bars are to be formed;

said applying step comprises applying said colored material upon a portion of respective predetermined lengths of the coil for each respective spacer bar to be formed with the width of said portion being substantially equal to the exposed side of the spacer bar to be formed;

slitting said sheet along said predetermined lengths; and said forming step comprises forming said predetermined widths into spacer bars such that the color is disposed on said exposed side.

3. The invention in accordance with claim 2 wherein said coil is made of metal.

4. The invention in accordance with claim 3 wherein the colored material applied is paint.

* * * * *